US010117013B2

(12) United States Patent
Tsuihiji

(10) Patent No.: US 10,117,013 B2
(45) Date of Patent: Oct. 30, 2018

(54) DIGITALLY DRIVEN HEADPHONE

(71) Applicant: Audio-Technica Corporation, Tokyo (JP)

(72) Inventor: Kenzo Tsuihiji, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 15/785,574

(22) Filed: Oct. 17, 2017

(65) Prior Publication Data

US 2018/0109866 A1 Apr. 19, 2018

(30) Foreign Application Priority Data

Oct. 18, 2016 (JP) ..... 2016-204606

(51) Int. Cl.
*H04R 1/10* (2006.01)
*H04R 9/06* (2006.01)

(52) U.S. Cl.
CPC ..... *H04R 1/1041* (2013.01); *H04R 1/1008* (2013.01); *H04R 1/1033* (2013.01); *H04R 1/1075* (2013.01); *H04R 9/06* (2013.01)

(58) Field of Classification Search
CPC ..... H04R 1/1041; H04R 1/008; H04R 1/0033
USPC ..... 381/74, 370–371, 376
See application file for complete search history.

(56) References Cited

U.S. PATENT DOCUMENTS 8,861,767 B2 * 10/2014 Lee ..... H04R 1/10 381/370
9,872,098 B2 * 1/2018 Tanoue ..... H04R 1/1033
2008/0166007 A1 * 7/2008 Hankey ..... H04R 1/083 381/380
2010/0239101 A1 * 9/2010 Okamura ..... H04R 1/005 381/71.1
2012/0243700 A1 * 9/2012 Jenkins ..... H04R 1/1083 381/72
2016/0142809 A1 5/2016 Tanoue et al.

FOREIGN PATENT DOCUMENTS

JP 2010-050647 A 3/2010
JP 2012-227589 A 11/2012

* cited by examiner

*Primary Examiner* — Disler Paul
(74) *Attorney, Agent, or Firm* — W&C IP

(57) ABSTRACT

A digitally driven headphone suppresses the occurrence of spurious radiation even when directly converting digital signals into sound waves. The digitally driven headphone includes a first sound emission unit, a second sound emission unit, and a signal line. The first sound emission unit includes at least one magnetic body into which the signal line is inserted, a signal processing circuit configured to process digital signals from a sound source, a circuit board on which the signal processing circuit is disposed, a driving part configured to drive the diaphragm in response to digital signals from the sound source, and a diaphragm configured to vibrate in response to driving of the driving part. The signal processing circuit has an output part disposed at an end portion of the circuit board. The signal line is inserted into the at least one magnetic body, and is connected to the output part and the second sound emission unit. The at least one magnetic body is disposed adjacent to the output part.

12 Claims, 7 Drawing Sheets

DIGITALLY DRIVEN HEADPHONE

TECHNICAL FIELD

The present invention generally relates to a digitally driven headphone.

BACKGROUND ART

Among various headphones, a headphone of an over-ear type, for example, is worn on the head of a user who listens to a music sound from a music player or the like. The headphone has a pair of sound emission units and a connection member connecting the sound emission units.

Each sound emission unit includes a driver unit and a housing accommodating the driver unit. The driver unit converts electrical signals (sound signals) from a sound source, such as a music player, into sound waves and outputs the sound waves.

Conventionally, electrical signals to be input into a driver unit of a headphone are analog signals. The driver unit outputs sound waves according to magnitudes of amplitudes and frequencies of analog signals. Thus, when sound signals from a sound source are digital signals, the digital signals are converted into analog signals by a digital-analog converter built in a music player or the like and transmitted to the headphones.

In recent years, a driver unit (hereinafter, referred to as "digital driver unit") capable of outputting desired sound waves according to digital signals without converting the digital signals into analog signals has been proposed (for example, refer to Japanese Unexamined Patent Publication No. 2012-227589).

The digital driver unit is a driver unit of a dynamic type, and includes one diaphragm and a plurality of voice coils. The individual digital signals (hereinafter, referred to as "processed signals") are applied to each voice coils. The processed signals are generated by a circuit for signal processing (hereinafter, referred to as "signal processing circuit"). The driver unit disclosed in Japanese Unexamined Patent Publication No. 2012-227589 can reproduce sound signals from a high frequency range to a low frequency range with high efficiency by driving (vibrating) the voice coils in response to processed signals.

By incorporating the digital driver unit and the signal processing circuit in a headphone, a headphone (hereinafter, referred to as "digitally driven headphone") in which a driving part of the driver unit is driven in response to digital signals is configured.

Among headphones, there is a headphone in which a headphone cable to be connected to a sound source is connected to only one sound emission unit (for example, refer to Japanese Unexamined Patent Publication No. 2010-050647). The headphone disclosed in Japanese Unexamined Patent Publication No. 2010-050647 includes a signal line (hereinafter, referred to as "connecting cord") transmits sound signals from one sound emission unit to the other sound emission unit. The connecting cord is connected to the inside of one sound emission unit and the inside of the other sound emission unit. The connecting cord is wired inside a connection member.

SUMMARY OF INVENTION

Technical Problem

In a digitally driven headphone including a connecting cord, a signal processing circuit is disposed, for example, inside a housing of one sound emission unit. Processed signals generated by the signal processing circuit are transmitted from the signal processing circuit to the digital driver unit. At this time, the processed signals are also transmitted to a digital driver unit of a sound emission unit in which the signal processing unit is not disposed, via the connecting cord.

Signal waveforms of the digital signals are in a rectangular form, and are composed by combining (summing) multi-order frequencies. Thus, digital signals contain harmonic components (high frequencies). These harmonic components can be emitted as spurious radiation (spurious emission) from the internal wiring of the headphone to which processed signals are transmitted. The digitally driven headphone drives a diaphragm according to a combination of digital signals output at a high-speed, and reproduces sound. Thus, power of harmonic components contained in the digital signals increases as a sum of the digital signals increases. As a result, spurious radiation easily occurs. In particular, the connecting cord is wired to be long across the head of a user, and accordingly, the connecting cord easily functions as an antenna and easily causes spurious radiation. Spurious radiation harmfully influences wireless communications and other electrical products. Thus, the amount of radiation is restricted in each country.

In a conventional headphone, signals to be transmitted to the connecting cord are analog signals of 20 kHz as an audible band (around 40 kHz in a high resolution sound source). Thus, in a conventional headphone, spurious radiation due to harmonics as in the digitally driven headphone does not occur.

Occurrence of spurious radiation can be suppressed by, for example, incorporating an electronic component such as a filter suppressing harmonic components in the signal processing circuit. However, a DC resistance component and a capacitive component contained in the electronic component influence sound quality (such as frequency characteristics and distortion characteristics) of sound waves output from the digital driver unit.

When a filter component is present in a path of transmission of processed signals, a rise of a rectangular wave constituting a digital signal is delayed. This delay influences a reproduced sound in a high frequency range. As a result, reproducibility in a high frequency range of sound waves output from the digital driver unit is deteriorated.

In order to effectively suppress occurrence of spurious radiation, for example, a large-sized electronic component is incorporated in a circuit board inside the housing. However, conventionally, a headphone has many movable parts, and is required to have an excellent design. Thus, concerning disposition of components inside the housing, both of the number and positions of components are limited, and it is difficult to secure a space for incorporation of a large-sized electronic component.

Occurrence of spurious radiation can be suppressed by, for example, making the housing of the sound emission unit and the connection member, etc., of conductive metal to constitute an electromagnetic shield by the housing and the connection member, etc. However, as described above, the headphone has many movable parts. Thus, due to the configuration of the headphone, it is technically difficult to realize an electromagnetic shield covering the entire headphone without omission. Even when the housing and the connection member, etc., are made of metal and constitute an electromagnetic shield, the weight of the headphone increases, and the wearing feeling of the headphone deteriorates. Further, in a digitally driven headphone using wireless transmission, a disposition means and a position of an antenna are limited by the electromagnetic shield. Thus, the design of the headphone is deteriorated.

As described above, a digitally driven headphone has a unique problem that hardly occurs in a conventional analog headphone in which a driving part is driven by analog signals.

An object of the present invention is to solve the problem described above and to provide a digitally driven headphone in which occurrence of spurious radiation is suppressed.

Solution to Problem

A digitally driven headphone according to the present invention includes a first sound emission unit, a second sound emission unit and a signal line. The first sound emission unit includes at least one magnetic body into which the signal line is inserted, a signal processing circuit configured to process digital signals from a sound source, a circuit board on which the signal processing circuit is disposed, a driving part configured to drive the diaphragm in response to digital signals from the sound source, and a diaphragm configured to vibrate in response to driving of the driving part. The signal processing circuit has an output part disposed at an end portion of the circuit board. The signal line is inserted into the at least magnetic body, and is connected to the output part and the second sound emission unit. The at least one magnetic body is disposed adjacent to the output part.

Advantageous Effects of Invention

According to the present invention, occurrence of spurious radiation can be suppressed even when digital signals are directly converted into sound waves.

DESCRIPTION OF EMBODIMENTS

Embodiments of a digitally driven headphone according to the present invention will now be described with reference to the attached drawings.

Configuration of Digitally Driven Headphone

Figure 1:
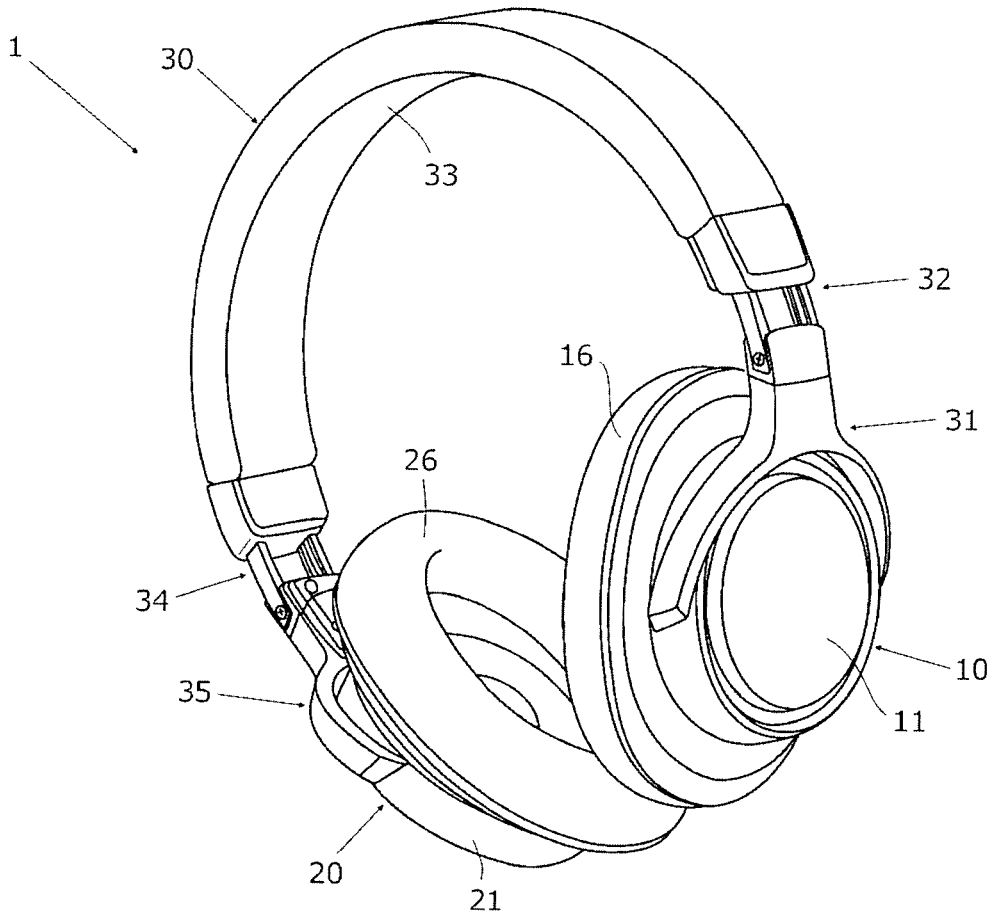
FIG. 1 is a perspective view showing an embodiment of a digitally driven headphone according to the present invention.

FIG. 1 is a perspective view showing an embodiment of a digitally driven headphone according to the present invention.

A digitally driven headphone (hereinafter, referred to as "headphone") 1 is worn on the head of a user and outputs sound waves corresponding to digital signals (sound signals) from a sound source S (see FIG. 3) such as a portable music player (not shown). The headphone 1 is a wired headphone into which sound signals are input from a sound source via, for example, a USB (Universal Serial Bus) cable (not shown).

The headphone according to the present invention may be a wireless headphone which receives sound signals from a sound source by using, for example, wireless transmission.

In the description below, the up and down, right and left, and front and rear directions of the headphone 1 respectively correspond to the up and down, right and left, and front and rear directions of a user wearing the headphone 1. That is, for example, of left and right sound emission units of the headphone 1, the left sound emission unit is a left sound emission unit 10 (described below) to be worn around the left ear of a user.

Figure 3:
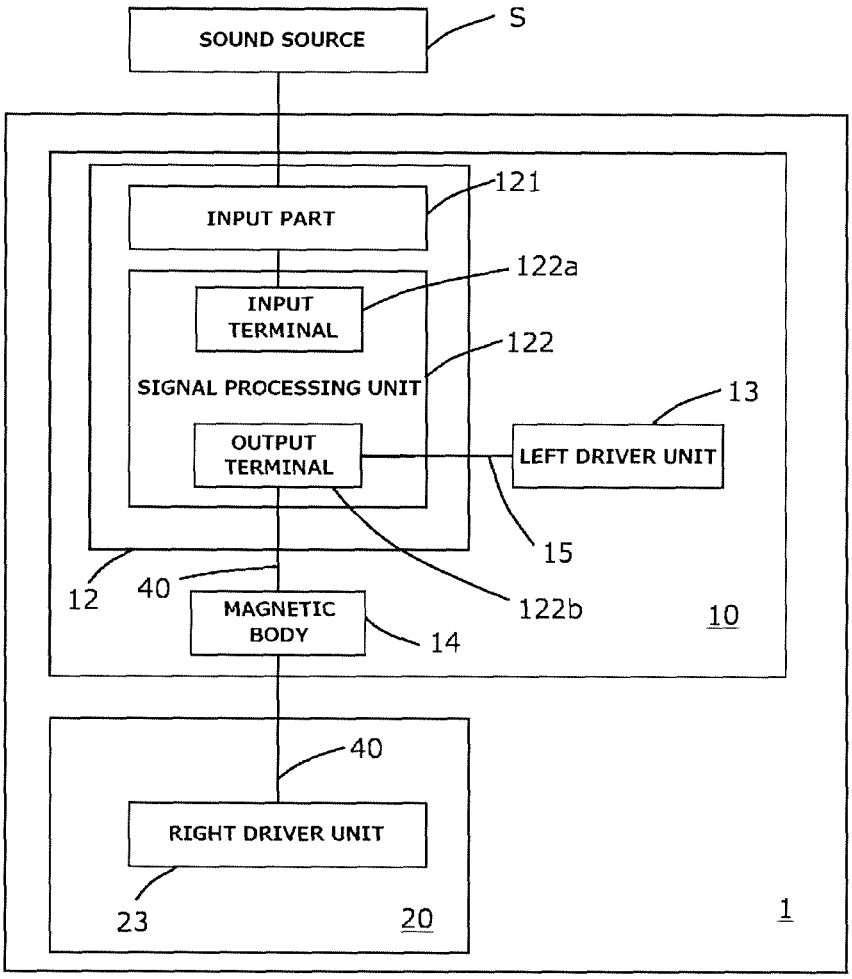
FIG. 3 is a function block diagram of the digitally driven headphone in FIG. 1.

The headphone 1 includes the left sound emission unit 10, a right sound emission unit 20, a connection member 30, and a signal line 40 (see FIG. 3). The left sound emission unit 10 and the right sound emission unit 20 constitute the pair of sound emission units.

Figure 2:
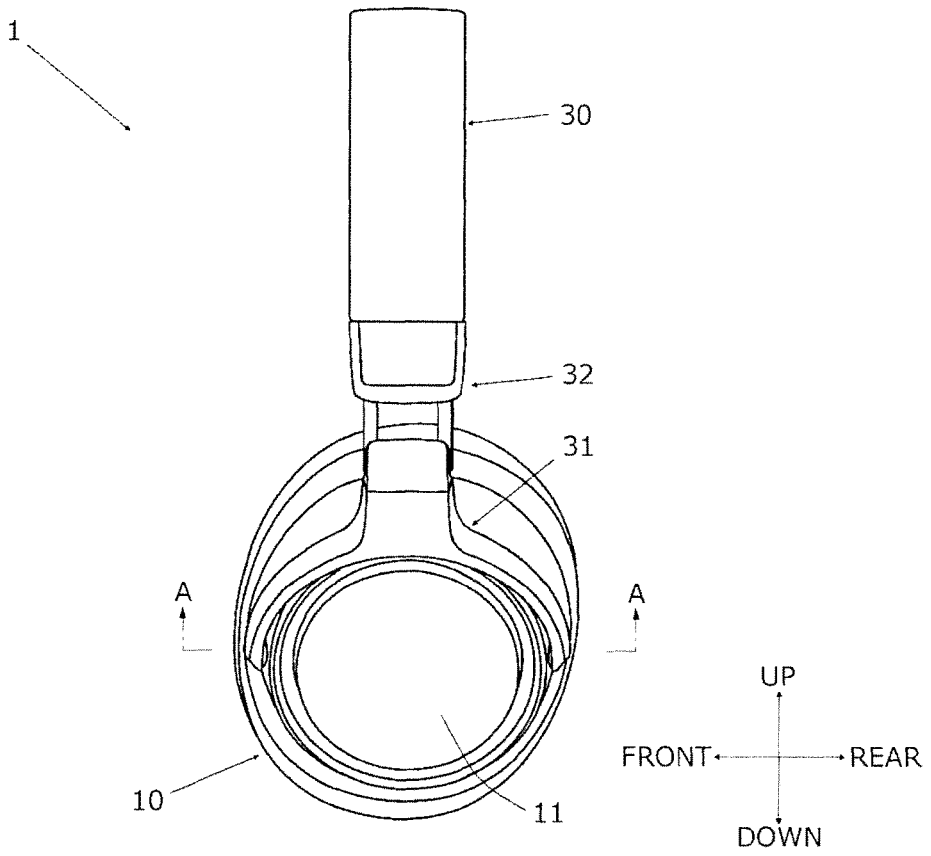
FIG. 2 is a right side view of the digitally driven headphone in FIG. 1.

FIG. 2 is a right side view of the headphone 1.

FIG. 3 is a function block diagram of the headphone 1.

Figure 4:
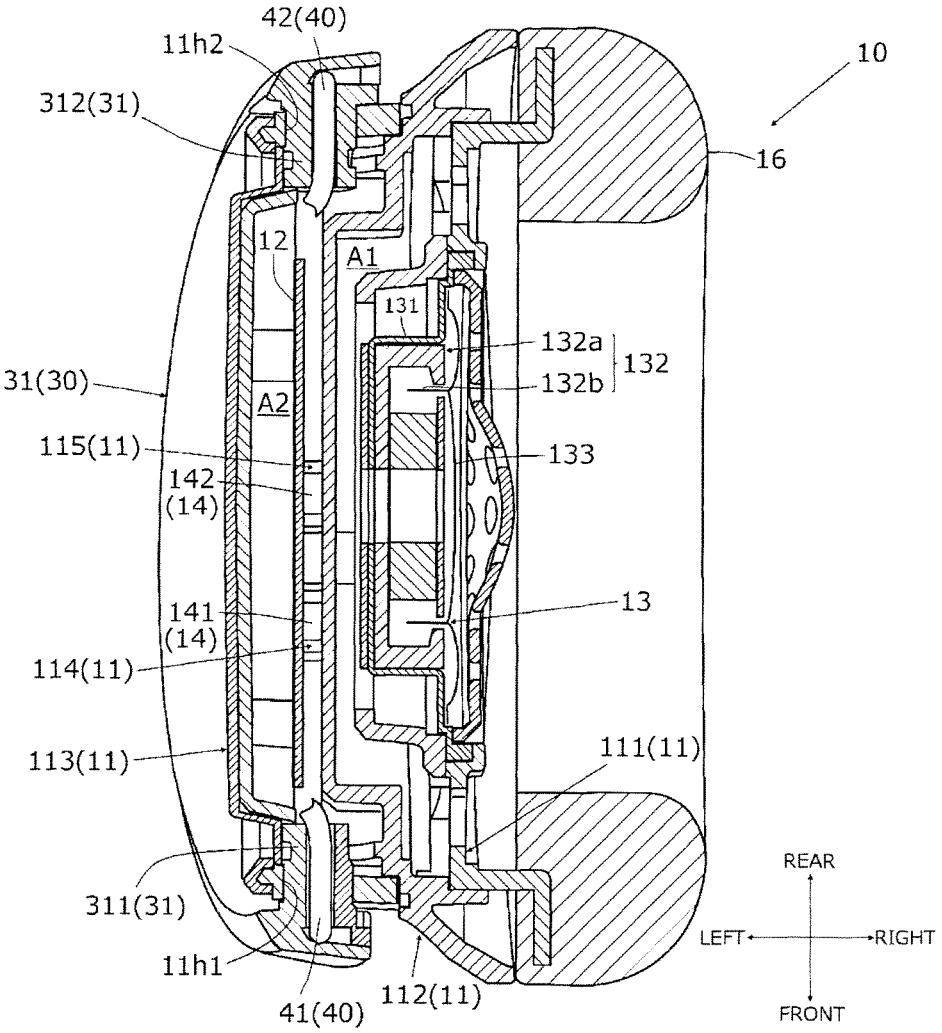
FIG. 4 is a cross-sectional view of a left sound emission unit of the digitally driven headphone in FIG. 2 taken along line A-A.

FIG. 4 is a cross-sectional view of the left sound emission unit 10 taken along line A-A in FIG. 2

The left sound emission unit 10 is worn around the left ear of a user and outputs sound waves corresponding to sound signals from a sound source. The left sound emission unit 10 includes a left housing 11, a circuit board 12, a left digital driver unit (hereinafter, referred to as "left driver unit") 13, magnetic bodies 14, a left signal line 15, and a left ear pad 16.

The left housing 11 accommodates the circuit board 12, the left driver unit 13, the magnetic bodies 14, and the left signal line 15. The left housing 11 includes a baffle plate 111, a left first housing 112, a left second housing 113, a first accommodation part 114, a second accommodation part 115, and two axial holes **11*h*1 and 11*h*2**.

The baffle plate 111 holds the left driver unit 13. The baffle plate 111 and the left first housing 112 define an air chamber A1 accommodating the left driver unit 13. The left first housing 112 and the left second housing 113 define an accommodation chamber A2 accommodating the circuit board 12 and the magnetic bodies 14.

Figure 5:
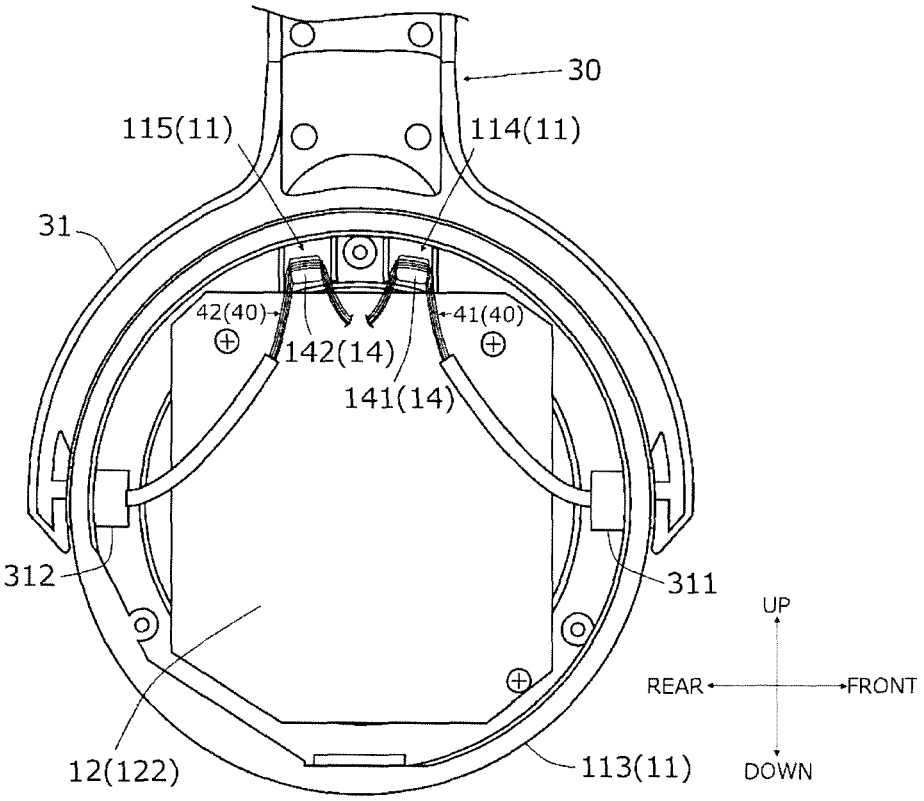
FIG. 5 is a left side view of a left second housing of the left sound emission unit in FIG. 4.

FIG. 5 is a left side view of the left second housing 113.

FIG. 5 shows a state of the left second housing 113 side viewed from the right side (the right side in FIG. 4) in a state where the left sound emission unit 10 is separated between the left first housing 112 and the left second housing 113. FIG. 5 omits a part of the signal line 40.

The first accommodation part 114 accommodates a first magnetic body 141 described below. The first accommodation part 114 is disposed at an upper portion of the inside of the left second housing 113 (the inside of the accommodation chamber A2). The first accommodation part 114 is constituted by, for example, a pair of ribs.

The second accommodation part 115 accommodates a second magnetic body 142 described below. The second accommodation part 115 is disposed at an upper portion of the inside of the left second housing 113 (the inside of the accommodation chamber A2). The second accommodation part 115 is constituted by, for example, a pair of ribs.

Two axial holes **11*h*1, 11*h*2 are holes into which axial portions 311 and 312 of a left hanger 31 described below are fit. The two axial holes 11*h*1, 11*h*2 are disposed at a front portion and a rear portion of the left second housing 113**.

Referring now back to FIG. 3 and FIG. 4, the circuit board 12 includes an input part 121 and a signal processing circuit 122. The input part 121 is a digital signal terminal, for example, a USB terminal or the like. Sound signals from a sound source S are input into the input part 121 via, for example, a USB cable. Sound signals to be input into the input part 121 are digital signals. The signal processing circuit 122 is configured to process the sound signals input into the input part 121 in the state of digital signals to generate signals to drive a diaphragm 133 described below. Signals processed by the signal processing circuit 122 (hereinafter, referred to as "processed signals") are transmitted to the left driver unit 13 via the left signal line 15, and transmitted to a right driver unit 23 described below via the signal line 40. The processed signals are digital signals obtained by, for example, applying pulse-density modulation (PDM) to sound signals. The circuit board 12 is attached to the inside of the left second housing 113. The signal processing circuit 122 includes an input terminal 122*a* and an output terminal 122*b*. The input terminal 122*a* is a terminal into which sound signals from the input part 121 are to be input. The output terminal 122*b* is a terminal which outputs processed signals to the left driver unit 13 and the right driver unit 23 described below. The output terminal 122*b* is disposed at an end portion (for example, an upper end portion) of the circuit board 11.

The left driver unit 13 directly converts processed signals as digital signals into sound waves and outputs the sound waves. The left driver unit 13 includes a unit case 131, a driving part 132, and a diaphragm 133.

The unit case 131 accommodates the driving part 132 and the diaphragm 133.

The driving part 132 is configured to drive (vibrate) in response to processed signals and thereby drives (vibrates) the diaphragm 133. The driving part 132 includes a magnetic circuit 132*a* and a plurality of (for example, four) voice coils 132*b*. The magnetic circuit 132*a* has a magnetic gap, and generates a magnetic flux inside the magnetic gap. The voice coil 132*b* drives in response to processed signals. The processed signals are composed of rectangular waves, and are applied to the respective voice coils 132*b*, individually.

The diaphragm 133 is configured to drive (vibrate) in response to driving (vibration) of the voice coils 132 and thereby generates sound waves. The diaphragm 133 is attached to the unit case 131. The diaphragm 133 attached to the unit case 131 is capable of vibrating relative to the unit case 131.

The voice coils 132*b* are attached to the diaphragm 133. The voice coils 132 are disposed inside the magnetic gap so as to traverse the magnetic flux generated in the magnetic circuit 132*a*. By electromagnetic forces generated by processed signals applied to the voice coils 132*b*, the voice coils 132*b* vibrate relative to the magnetic circuit 132*a*.

The number of voice coils of the headphone according to the present invention is not limited to four.

Figure 6:
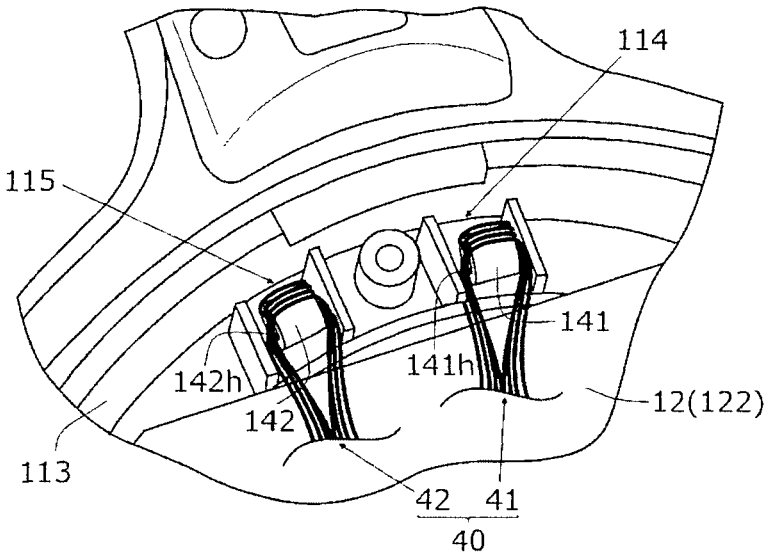
FIG. 6 is a perspective view partially enlarging the left second housing in FIG. 5.

FIG. 6 is a perspective view enlarging an upper portion of the left second housing 113 in the state shown in FIG. 5.

FIG. 6 shows an upper portion of the circuit board 12, an upper portion of the left second housing 113, the magnetic bodies 14, and a part of the signal line 40.

The magnetic body 14 removes high-frequency components (high-order harmonics) of a predetermined frequency or more from processed signals (rectangular waves) flowing through the signal line 40. In the present embodiment, the left sound emission unit 10 includes two magnetic bodies consisting of a first magnetic body 141 and a second magnetic body 142. The predetermined frequency will be described below.

The first magnetic body 141 is a cylindrical ferrite core corresponding to a first branch line 41 described below. The first magnetic body 141 has an insertion hole 141*h*. The insertion hole 141*h* extends along the axial direction of the first magnetic body 141. The first magnetic body 141 is accommodated in the first accommodation part 114. A function of the first magnetic body 141 will be described below.

The second magnetic body 142 is a cylindrical ferrite core corresponding to a second branch line 42 described below. The second magnetic body 142 has an insertion hole 142*h*. The insertion hole 142*h* extends along the axial direction of the second magnetic body 142. The second magnetic body 142 is accommodated in the second accommodation part 115. A function of the second magnetic body 142 will be described below.

The first accommodation part 114 and the second accommodation part 115 are disposed inside the accommodation chamber A2. The accommodation chamber A2 is separated from the air chamber A1 accommodating the left driver unit 13 by the left first housing 112. Thus, the first magnetic body 141 and the second magnetic body 142 are not influenced by the magnetic circuit 132*a* included in the left driver unit.

Referring now back to FIG. 1, the left ear pad 16 is a buffer between the left housing 11 and the head of a user. The left ear pad 16 is attached to the left housing 11.

The right sound emission unit 20 is worn around the right ear of a user and outputs sound waves corresponding to sound signals from a sound source. The right sound emission unit 20 has the same configuration as the left sound emission unit 10 except that the right sound emission unit 20 does not include the circuit board (the input part, the signal processing circuit), the magnetic bodies, and the left signal line. That is, the right sound emission unit 20 includes a right housing 21, a right digital driver unit (hereinafter, referred to as "right driver unit") 23 (see FIG. 3), and a right ear pad 26.

The connection member 30 connects the pair of sound emission units 10 and 20. The connection member 30 has an arched shape along a shape of the head of a user. The connection member 30 includes a left hanger 31, a left slide mechanism 32, a head band 33, a right slide mechanism 34, and a right hanger 35.

The left hanger 31 supports the left sound emission unit 10. The left sound emission unit 10 supported by the left hanger 31 is swingable relative to the left hanger 31. The left hanger 31 is hollow, and has a lower portion in a reversed Y shape diverging in front-rear direction. The left hanger 31 includes a pair of axial portions 311 and 312 (see FIG. 4). The pair of axial portions 311 and 312 are fit into the axial holes 11*h*1 and 11*h*2 of the left second housing 113. The pair of axial portions 311 and 312 fit into the axial holes 11*h*1 and 11*h*2 are rotatable relative to the left second housing 113.

The left slide mechanism 32 slides along a longitudinal direction of the connection member 30 to change a distance between the left sound emission unit 10 and the head band 33.

The head band 33 connects the left slide mechanism 32 and the right slide mechanism 34. The head band 33 is made of, for example, synthetic resin having predetermined rigidity and resilience. The head band 33 includes a resilience member (not shown). The resilience member is, for example, a plate spring. The resilience member is disposed inside the head band 33. By a resilience force of the resilience member, the left sound emission unit 10 and the right sound emission unit 20 are biased in directions to approach each other.

The right slide mechanism 34 slides along the longitudinal direction of the connection member 30 to change a distance between the right sound emission unit 20 and the head band 33.

The right hanger 35 supports the right sound emission unit 20. The right sound emission unit 20 supported by the right hanger 35 is swingable relative to the right hanger 35. The right hanger 35 has the same configuration as the left hanger 31.

Next, the signal line 40 will be described with reference to FIG. 3 and FIG. 5.

The signal line 40 transmits processed signals from the signal processing circuit 122 of the left sound emission unit 10 to the voice coils (not shown) of the right driver unit 23 of the right sound emission unit 20. The signal line 40 is a "connecting cord" wired between the left sound emission unit 10 and the right sound emission unit 20. That is, the signal line 40 is connected to the voice coils (not shown) of the right driver unit 23 from the signal processing circuit 122 in the left sound emission unit 10 via the magnetic bodies 14. The signal line 40 includes a plurality of audio system lines.

The audio system lines transmit processed signals to the respective four voice coils of the right driver unit 23. Audio system lines necessary for one voice coil consist of two lines of a positive transmission line and a negative transmission line.

The signal line 40 is divided into the first branch line 41 and the second branch line 42. The first branch line 41 is formed by bundling four audio system lines corresponding to two voice coils. The second branch line 42 is formed by bundling four audio system lines corresponding to the remaining two voice coils. That is, the signal line 40 is divided into two branch lines 41 and 42.

The positive transmission lines and negative transmission lines for processed signals corresponding to the respective voice coils may be twisted together and constitute four twisted wires. In this case, among the four twisted wires, two twisted wires constitute a first branch line, and the remaining two twisted wires constitute a second branch line.

Wiring of Signal Line 40

The wiring of the signal line 40 will now be described.

The first branch line 41 and the second branch line 42 are connected to the signal processing circuit 122 of the left sound emission unit 10 and the driving part of the right driver unit 23 of the right sound emission unit 20. The first branch line 41 and the second branch line 42 are wired inside the left second housing 113 (accommodation chamber A2), the connection member 30, and the right housing 21.

Figure 7:
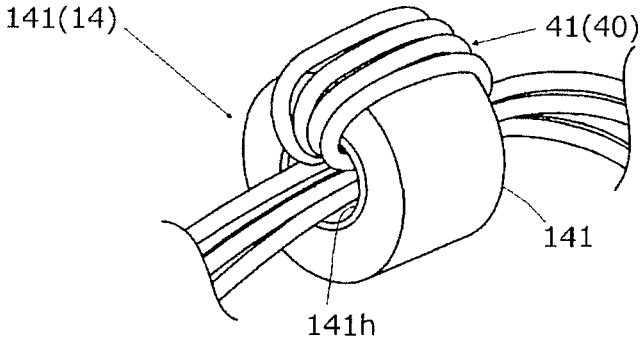
FIG. 7 is an enlarged view of a signal line and a magnetic body of the left sound emission unit shown in FIG. 4.

FIG. 7 is an enlarged perspective view of the first branch line 41 and the first magnetic body 141.

The first branch line 41 is wound around the first magnetic body 141 between the signal processing circuit 122 of the circuit board 12 and the axial portion 311 of the left hanger 31 as shown in FIG. 5. The number of windings of the first branch line 41 around the first magnetic body 141 is "2" (two turns). That is, the first branch line 41 is inserted twice into the insertion hole 141*h* of the first magnetic body 141. The first magnetic body 141 is disposed proximal and adjacent to the output terminal 122*b* of the signal processing circuit 122 in a state where the first branch line 41 is wound around the first magnetic body 141.

The second branch line 42 is wound around the second magnetic body 142 between the signal processing circuit 122 of the circuit board 12 and the axial portion 312 of the left hanger 31 as shown in FIG. 5. The number of windings of the second branch line 42 around the second magnetic body 142 is "2" (two turns). That is, the second branch line 42 is inserted twice into the insertion hole 142*h* of the second magnetic body 142. The second magnetic body 142 is disposed proximal and adjacent to the output terminal 122*b* of the signal processing circuit 122 in a state where the second branch line 42 is wound around the second magnetic body 142.

Here, the magnetic body 14 being disposed proximal and adjacent to the output terminal 122*b* of the signal processing circuit 122 is not limited to a case where the magnetic body 14 is disposed in contact with the output terminal 122*b* of the signal processing circuit 122, but also includes a case where the magnetic body 14 is disposed near the signal processing circuit 122.

The first magnetic body 141 and the second magnetic body 142 are cylindrical, so that the first branch line 41 and the second branch line 42 are easily and reliably inserted into the first magnetic body 141 and the second magnetic body 142.

The first accommodation part 114 and the second accommodation part 115 are disposed at an upper portion of the left second housing 113, that is, near the connection member 30 inside the left housing 11 as shown in FIG. 5. The axial portion 311 in which the first branch line 41 is wired and the axial portion 312 in which the second branch line 42 is wired are respectively disposed at a front portion and a rear portion of the left housing 11. The output terminal 122*b* of the signal processing circuit 122 is disposed at an upper end portion of the circuit board 12, that is, near the connection member 30. Thus, the first branch line 41 is wired between the first accommodation part 144 and the axial portion 311 while avoiding electronic components, without being subjected to an excessive mechanical load. The second branch line 42 is wired between the second accommodation part 115 and the axial portion 312 while avoiding electronic components, without being subjected to an excessive mechanical load. In addition, the first branch line 41 and the second branch line 42 are uniformly wired inside the left housing 11. As a result, portions of the first branch line 41 and the second branch line 42 wound around the first magnetic body 141 and the second magnetic body 142 are not subjected to mechanical loads. Thus, no defects such as breakage occur on the first branch line 41 and the second branch line 42.

Operation of Headphone 1

The operation of the headphone 1 will now be described.

Generally, a magnetic body and a lead wire inserted into the magnetic body constitute a coil (inductor). The higher the frequency, the higher the impedance of this coil (inductor) becomes. Thus, the coil (inductor) functions as a low-pass filter with respect to a current flowing through the lead wire. That is, high-frequency components of the current flowing through the lead wire attenuate. A cutoff frequency of this coil (inductor) changes depending on the type, size, and shape of the magnetic body and the number of times of insertion of the lead wire into the magnetic body (the number of turns), etc. High-frequency components of the current flowing through the lead wire are consumed as heat and attenuate by a magnetic loss caused by magnetization of the magnetic body.

As described above, a processed signal to be output from the signal processing circuit 122 is a digital signal composed of a combination of multi-order frequencies that is, containing harmonic components. The first branch line 41 to which processed signals are transmitted is inserted into the first magnetic body 141, and the second branch line 42 to which processed signals are transmitted is inserted into the second magnetic body 142. Thus, high-frequency components of processed signals transmitted to the first branch line 41 and the second branch line 42 attenuate at the portions wound around the first magnetic body 141 and the second magnetic body 142. Here, high-frequency components to be attenuated are frequency components of a megahertz band as spuriously radiated high-frequency components, and are not frequency components of a band that influences the characteristics of the headphone 1 (for example, 20 kHz or less, or around 40 kHz in the case of a high resolution sound source). Thus, even when the frequency components of this band attenuate, influence of this attenuation on the frequency characteristics of the headphone 1 is small. As a result, spurious radiation from the signal line (connecting cord) 40 is suppressed without influence on the frequency characteristics of the headphone 1. That is, the headphone according to the present invention suppresses the occurrence of spurious radiation by a simple configuration in which the magnetic bodies 14 are attached to the signal line 40.

The number of turns of the first branch line 41 and the number of turns of the second branch line 42 are not limited to two. That is, for example, the numbers of turns of the first branch line 41 and the second branch line 42 may be one or three, etc., according to the frequency band desired to be attenuated.

Synopsis

In the digitally driven headphone according to the embodiment described above, the left sound emission unit 10 includes magnetic bodies (ferrite cores) 14. A signal line (connecting cord) 40 to be wired between the pair of sound emission units 10 and 20 is inserted into the magnetic bodies 14. The magnetic bodies 14 are disposed proximal to the output terminal 122*b* of the signal processing circuit 122. Thus, high-frequency components of processed signals (digital signals) transmitted to the signal line 40 attenuate at a portion inserted into the magnetic body 14. As a result, processed signals from which high-order harmonics of a megahertz band are cut are transmitted to the signal line 40. Thus, spurious radiation from the signal line 40 is suppressed. That is, the headphone according to the present invention suppresses occurrence of spurious radiation by a simple configuration in which magnetic bodies 14 are attached to the signal line 40. As described above, as the magnetic bodies 14 are disposed proximal and adjacent to the output terminal 122*b* of the signal processing circuit 122, as compared with a case where the magnetic bodies are not disposed adjacent to the output terminal, an effect of attenuating harmonic components of processed signals increases.

The signal line 40 is divided into the first branch line 41 and the second branch line 42. Thus, the first magnetic body 141 corresponding to the first branch line 41 and the second magnetic body 142 corresponding to the second branch line 42 can be downsized. In addition, attachment of the first branch line 41 to the first magnetic body 141 and attachment of the second branch line 42 to the second magnetic body 142 become easy.

The left housing 11 of the left sound emission unit 10 includes the first accommodation part 114 accommodating the first magnetic body 141 and the second accommodation part 115 accommodating the second magnetic body 142. That is, the first magnetic body 141 and the second magnetic body 142 are accommodated individually in the first accommodation part 114 and the second accommodation part 115. Thus, the first magnetic body 141 and the second magnetic body 142 do not interfere with each other inside the left housing 11.

The first accommodation part 114 and the second accommodation part 115 are disposed near the connection member 30 inside the left housing 11. Thus, the first branch line 41 and the second branch line 42 are not subjected to a mechanical load such as bending inside the left housing 11. As a result, a defect such as breakage does not occur at a portion of the signal line 40 to be wound around the magnetic body 14.

The air chamber A1 in which the left driver unit 13 is disposed is separated from the accommodation chamber A2 in which the magnetic bodies 14 are disposed. Thus, even when the magnetic bodies 14 are not disposed in the right sound emission unit 20, the left sound emission unit 10 and the right sound emission unit 20 do not cause acoustic unevenness (are acoustically even).

The magnetic body is not limited to a ferrite core as long as it can attenuate predetermined high-frequency components from processed signals.

In the embodiment described above, the headphone 1 includes two magnetic bodies (the first magnetic body 141 and the second magnetic body 142). However, in the present invention, the number of magnetic bodies that the headphone includes may be one. That is, for example, the first branch line and the second branch line may be wound around one common magnetic body.

Further, in the embodiment described above, the signal line 40 is divided into two branch lines, and each branch line is wound around a corresponding magnetic body. However, in the present embodiment, the signal line may not be divided into a plurality of branch lines, or may be divided into three or more branch lines.

Further, the first magnetic body and the second magnetic body may be disposed at the axial portions of the left hanger.

Figure 8:
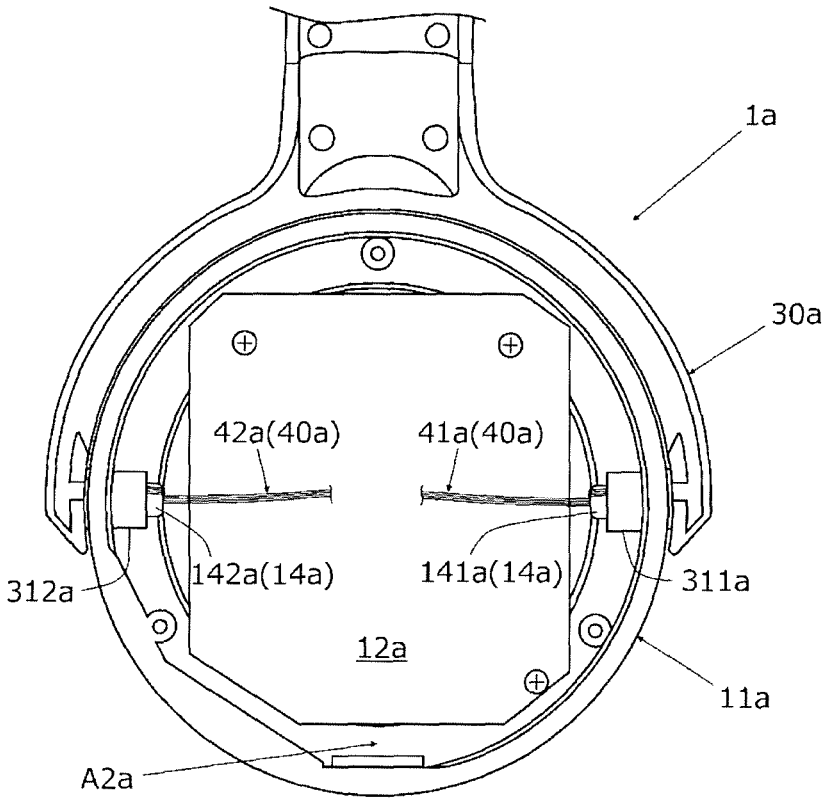
FIG. 8 is a left side view of a left second housing in another embodiment of a digitally driven headphone according to the present invention.

FIG. 8 is a left side view of a left second housing in another embodiment of a digitally driven headphone according to the present invention.

A first magnetic body 141*a* is disposed inside an axial portion 311*a* of a left hanger 30*a*. A second magnetic body 142*a* is disposed inside an axial portion 312*a* of a left hanger 30*a*. That is, the magnetic bodies 14*a* (141*a* and 142*a*) are disposed at outlets of a left housing 11*a* and an accommodation chamber A2*a* (portions at which a first branch line 41*a* and a second branch line 42*a* are wired from the left housing 11*a* and the accommodation chamber A2*a* to the left hanger 30*a*). At this time, the axial portion 311*a* functions as an accommodation part for the first magnetic body 141*a*, and the axial portion 312*a* functions as an accommodation part for the second magnetic body 142*a*. A signal processing circuit (not shown) is disposed near a central portion of a circuit board 12*a*. An output terminal (not shown) of the signal processing circuit is disposed at, for example, the lower side (the lower side in FIG. 8) of the signal processing circuit.

This configuration is effective particularly in the case where the entire left housing 11*a* and the accommodation chamber A2*a* are electromagnetically shielded. That is, by disposing the magnetic bodies 14*a* at the outlets of the left housing 11*a* and the accommodation chamber A2*a*, high-order harmonics of processed signals are not transmitted to the outside of the left housing 11*a*, etc. Thus, spurious radiation from the signal line 40*a* is prevented from occurring. In addition, the axial portions 311*a* and 312*a* and the magnetic bodies 14*a* are configured integrally, so that they have no influences on the design and downsizing of the digitally driven headphone 1*a*, and the design of the digitally driven headphone 1*a* is improved.

The invention claimed is:

1. A digitally driven headphone comprising:
a first sound emission unit;
a second sound emission unit; and
a signal line, wherein
the first sound emission unit comprises:
at least one magnetic body into which the signal line is inserted,
a signal processing circuit configured to process digital signals from a sound source,
a circuit board on which the signal processing circuit is disposed,
a driving part configured to drive in response to the digital signals processed by the signal processing circuit, and
a diaphragm configured to vibrate in response to driving of the driving part,
wherein the driving part comprises:
a magnetic circuit, and
a voice coil which is disposed in a magnetic flux generated in the magnetic circuit,
the signal processing circuit has an output part disposed at an end portion of the circuit board which outputs the digital signals processed by the signal processing circuit to the voice coil and the second sound emission unit,
the signal line is inserted into the at least one magnetic body, and is connected to the output part of the signal processing circuit and the second sound emission unit, and
the at least one magnetic body is disposed adjacent to the output part.

2. The digitally driven headphone according to claim 1, further comprising:
a connection member connecting the first sound emission unit and the second sound emission unit, wherein
the output part is disposed at an end portion of a connection member side of the end portion of the circuit board.

3. The digitally driven headphone according to claim 1, wherein
the driving part comprises a plurality of voice coils to which the digital signals processed by the signal processing circuit are applied, and
the plurality of voice coils drive the diaphragm.

4. The digitally driven headphone according to claim 1, wherein the signal line is wound around the at least one magnetic body.

5. The digitally driven headphone according to claim 1, wherein
the signal line is divided into a plurality of branch lines.

6. The digitally driven headphone according to claim 5, wherein
the at least one magnetic body is a plurality of magnetic bodies.

7. The digitally driven headphone according to claim 6, wherein
the plurality of branch lines comprise:
a first branch line; and
a second branch line,
the plurality of magnetic bodies comprise:
a first magnetic body into which the first branch line is inserted; and
a second magnetic body into which the second branch line is inserted.

8. The digitally driven headphone according to claim 1, wherein
the first sound emission unit comprises a housing accommodating the diaphragm and the driving part, and
the housing comprises at least one accommodation part accommodating the at least one magnetic body.

9. The digitally driven headphone according to claim 8, further comprising:
a connection member connecting the first sound emission unit and the second sound emission unit, wherein the at least one accommodation part is disposed near the connection member inside the housing.

10. The digitally driven headphone according to claim 8, wherein
the housing comprises:
an air chamber in which the driving part is disposed, and
an accommodation chamber in which the accommodation part is disposed, and
the air chamber is separated from the accommodation chamber.

11. The digitally driven headphone according to claim 1, wherein the at least one magnetic body is a cylindrical ferrite core.

12. A digitally driven headphone comprising:
a first sound emission units;
a second sound emission units;
a connection member connecting the first sound emission unit and the second sound emission unit; and
a signal line, wherein
the first sound emission unit comprises:
a magnetic body into which the signal line is inserted,
a driving part configured to drive in response to the digital signals processed by the signal processing circuit,
a diaphragm configured to vibrate in response to driving of the driving part, and
a housing accommodating the diaphragm and the driving part,
a signal processing circuit configured to process digital signals from the sound source,
wherein the driving part comprises:
a magnetic circuit, and
a voice coil which is disposed in a magnetic flux generated in the magnetic circuit,
the connection member comprises an axial portion,
the housing comprises an axial hole into which the axial portion is inserted,
the magnetic body is disposed inside the axial portion, and
the signal line is connected to the signal processing circuit and the second sound emission unit.

* * * * *